US006005206A

United States Patent [19]

Rakus et al.

[11] Patent Number: 6,005,206

[45] Date of Patent: Dec. 21, 1999

[54] ELECTRICAL SWITCHING APPARATUS WITH IMPROVED CONTACT ARM CARRIER ARRANGEMENT

[75] Inventors: Paul Richard Rakus, Hopewell Township; Glen Charles Sisson, Center Township; Perry Robert Gibson, Chippewa Township; Keith Lynn Mayhood, Pittsburgh, all of Pa.

[73] Assignee: Eaton Corporation, Cleveland, Ohio

[21] Appl. No.: 09/074,075

[22] Filed: May 7, 1998

[51] Int. Cl.[6] ..... H01H 77/00

[52] U.S. Cl. ..... 200/244; 218/20; 335/15

[58] Field of Search ..... 200/244, 250; 218/14, 20, 18, 21, 6, 153; 335/15, 132, 156, 203

[56] References Cited

U.S. PATENT DOCUMENTS 4,709,127 11/1987 Adam .
4,719,325 1/1988 Kroll et al. .
4,764,650 8/1988 Bur et al. ..... 218/153 X
5,210,385 5/1993 Morel et al. ..... 218/9
5,847,629 12/1998 Helms et al. ..... 335/16
5,874,699 2/1999 Beck et al. ..... 200/244

*Primary Examiner*—Renee S. Luebke
*Attorney, Agent, or Firm*—Martin J. Moran

[57] ABSTRACT

The contact fingers of electrical switching apparatus have radial convex surfaces centered on the pivot pins which seat on concave surfaces in the molded contact carrier to transmit bending loads on the pin into the carrier. A seal member which snaps onto the end of the pivot pin has fins which extend between the contact fingers to block flow of arcing gases through the carrier. For lower current ratings, some of the contact fingers are replaced by annular spacers which also transmit bending moments into the carrier and restrict gas flow. A stop ledge on the carrier against which the contact springs bias the contact fingers has a recess which allows the center fingers to project farther toward the stationary contacts so that the arc toes on these fingers are the last to separate on opening and the arc is concentrated on them. The drive pin connecting the carrier to the operating mechanism has flats which key it for engagement in a slot in the carrier for installation and removal only with the carrier pivots lifted out of their bearing pockets by removal of the rear casing.

19 Claims, 10 Drawing Sheets

ELECTRICAL SWITCHING APPARATUS WITH IMPROVED CONTACT ARM CARRIER ARRANGEMENT

CROSS REFERENCES TO RELATED APPLICATIONS

This application is related to commonly owned, concurrently filed Patent Applications:

Ser. No. 09/074,135 filed May 7, 1998, now U.S. Pat. No. 5,899,323 issued May 4, 1999, "ELECTRICAL SWITCHING APPARATUS WITH CONTACT FINGER GUIDE";

Ser. No. 09/074,073 filed May 7, 1998, now abandon, "CHARGING MECHANISM FOR SPRING POWERED ELECTRICAL SWITCHING APPARATUS";

Ser. No. 09/074,240, filed May 7, 1998, "ELECTRICAL SWITCHING APPARATUS WITH MODULAR OPERATING MECHANISM FOR MOUNTING AND CONTROLLING LARGE COMPRESSION CLOSE SPRING";

Ser. No. 09/074,233, filed May 7, 1998, "ELECTRICAL SWITCHING APPARATUS WITH PUSH BUTTONS FOR A MODULAR OPERATING MECHANISM ACCESSIBLE THROUGH A COVER PLATE";

Ser. No. 09/074,107, filed May 7, 1998, "INTERLOCK FOR ELECTRICAL SWITCHING APPARATUS WITH STORED ENERGY CLOSING";

Ser. No. 09/074,133, filed May 7, 1998, "CLOSE PROP AND LATCH ASSEMBLY FOR STORED ENERGY OPERATING MECHANISM OF ELECTRICAL SWITCHING APPARATUS";

Ser. No. 09/074,076, filed May 7, 1998, "SNAP ACTING CHARGE/DISCHARGE INDICATOR DISPLAYING CHARGE STATE OF CLOSE SPRING ON ELECTRICAL SWITCHING APPARATUS";

Ser. No. 09/074,234, filed May 7, 1998, "ELECTRICAL SWITCHING APPARATUS HAVING ARC RUNNER INTEGRAL WITH STATIONARY ARCING CONTACT"; and Ser. No. 09/074,052, filed May 7, 1998, "DISENGAGEABLE CHARGING MECHANISM FOR SPRING POWERED ELECTRICAL SWITCHING APPARATUS"

The Government has rights in this invention under Government Contract Number N61331-94-C-0078

BACKGROUND OF THE INVENTION

FIELD OF THE INVENTION

This invention relates to electrical switching apparatus and more particularly to the construction and interaction of the contact fingers, contact carrier supporting the contact fingers and the pole shaft in multipole electrical switching apparatus.

BACKGROUND INFORMATION

Electrical switching apparatus for power distribution systems includes devices such as, for instance, circuit breakers, network protectors, transfer switches and disconnect switches. A common type of power air circuit breaker has a molded casing housing multiple pole assemblies all driven by a common operating mechanism through a rotatable pole shaft. Each pole includes a contact arm carrier pivoted by a pole arm on the pole shaft between closed and open positions. The contact arm carriers support contact arms having movable contacts which engage stationary contacts with the contact arm carrier in the closed position. Typically, the contact arm is made up of a number of contact arm laminations or fingers mounted on a common pivot pin on the carrier. Contact springs bias the contact fingers against the stationary contacts in the closed position to provide contact pressure and to accommodate for wear. Sealed are chambers around the contacts contain the arc generated gases, thereby improving interruption performance and pole isolation. As mentioned, the contact fingers pivot on the contact arm carrier. There is a need to permit the contact fingers to pivot without creating a significant bypass path for arc gases around the fingers. There is also a need to support the fingers on the pivot pin with adequate strength to maintain their positions against fault current electromagnetic forces. The pivot pin must be of substantial diameter to span the multiple fingers and maintain adequate stiffness. This requires a large pin consisting of substantial mass and material. It also results in a large hole in the contact finger, again requiring additional material and cost. Finally, since the load of each finger is carried by the finger pivot pin to bearing points on the contact carrier, substantial strength of these outboard bearing points is required in the contact arm carrier. It is also desirable to have a standard design which can be adapted for a range of current ratings. This would require reducing the number of contact fingers while maintaining the gas seal.

It is known to space the movable main contacts from the free ends of the contact fingers which then serve as arcing toes which contact stationary arcing contacts during closing of the circuit breaker before the main contacts close and which then cause the contact fingers to rock about the common pivot pin as the main contacts engage. On opening, the contact springs again rock the contact fingers so that the arcing contacts do not separate until after the main contacts, and, therefore, draw the arc which precedes current interruption. Where arcing toes are provided across all of the contact fingers, there is potential for the arc to form at any point across the pole. The arc is most likely to originate where the arcing contacts last part during the opening of the pole. Because the arcing contacts all part at nominally the same point in the opening of the pole, minor variations due to manufacturing tolerances can cause the location of the last parting of contacts to vary. Thus, the arc may form anywhere across the pole, frequently near an outside edge. This offset position of the arc can lead to interruption performance failures.

One manufacturer has limited the width of the stationary arcing contact to the center of the pole in order to center the arc. The disadvantage of this arrangement is that, while commonality of all the contact fingers is retained, the outboard fingers "land" on the main contacts, rather than on the harder arcing contacts. This results in premature wear and flattening of the main contacts during product life. Another manufacturer removes the arcing end of the fingers on the outboard contact fingers in order to center the arc. This has the same disadvantage of accelerating the wear of the main contacts on the outboard fingers, and also requires the use of two different styles of contact fingers.

In air circuit breakers with integral arc chamber seals, there is a need to install and remove the moving contact carrier assembly (i.e. the contact carrier) during initial assembly and subsequent service. However, access to the drive linkage is obstructed by the arc chamber seals. The present technology consists of an access port in the top seal surface of the contact carrier through which a tool is inserted to operate an uncoupling device. The typical device is a transverse pin which slides into or out of the drive link and is held in position by a spring or set screw.

The disadvantage of this approach is the cost of the parts required to hold the spring in position. Furthermore, inserting the tool and sliding the pin to the side is a time consuming and awkward operation. It may be difficult to slide the pin if debris is present, and in the case of a set screw device, the pin may inadvertently be left in the disengaged position, or the set screw left untightened.

There is a need therefore for improved electrical switching apparatus such as power air circuit breakers which overcome these disadvantages.

SUMMARY OF THE INVENTION

This need and others are satisfied by the invention which is directed to electrical switching apparatus in which the contact carrier has concave surfaces radially aligned with the pivot pin for the contact fingers and on which radial convex surfaces on the rotatable contact fingers seat to transmit the reaction forces imposed on the contact fingers with the contacts closed into the contact carrier. This reduces bending of the pivot pin and allows it and its supports to be reduced in size. For lower rating applications, some of the contact fingers are replaced by annular spacers which also seat on the radial concave surfaces of the carrier. As another aspect of the invention, the contact carrier has grooves in which radially extending lateral extensions on the contact fingers seat to provide a seal confining the arcing gases generated during current interruption. The bottoms of these grooves form the radial surfaces against which the contact fingers seat. The contact carrier preferably has a body in which the pivot pin is mounted and a seal member which engages the body and provides seal means which extend between the fingers to confine the arc gases. This seal member also has radially concave surfaces against which the contact fingers, and spacers, where provided, seat. The seal member has spaced apart legs with confronting recesses which engage the ends of the pivot pin to secure the seal member to the carrier body. The seating of the contact fingers against the radial surfaces in the grooves in the contact body and the radially concave surfaces in the seal member maintain the gas seal while permitting the contact fingers to pivot.

As another aspect of the invention, the stop surface against which contact springs bias the contact fingers when the contact carrier is not in a closed position, has a contour which projects selected ones of the contact fingers farther toward the stationary contacts than others of the contact fingers. This results in the arcing toes on the selected contact fingers contacting the stationary arcing contacts or toe blocks first on closing and separating last on opening so that the arc is focused on arcing toes of these contact fingers. Preferably, the selected contact fingers are the inner fingers. This arrangement allows the arc to be concentrated on the inner fingers without undue wear on the main contacts of the other fingers, and without the need to have a different configuration for the fingers subjected to the arc.

As another aspect of the invention, the contact carrier is connected to the pole arm of the electrical switching apparatus operating mechanism by connecting means which includes a link connected to the pole arm adjacent one end and having a drive pin extending transversely from a second end. The contact carrier has a groove sized to pivotally receive the link, a passage within the contact carrier transverse to the groove and a slot in the groove leading to the passage. The slot is narrower than the passage. The drive pin is freely rotatable in the passage and keyed to slide through the slot only with a predetermined rotational orientation between the drive pin and the contact carrier. The pivot mounting the carrier is releasable to allow rotation of the contact carrier to a predetermined orientation for insertion into and withdrawal from the passage of the drive pin through the slot.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention is applicable to electrical switching apparatus such as, for example, circuit breakers, network protectors, transfer switches and disconnect switches, and will be described as applied to a power circuit breaker.

Figure 1:
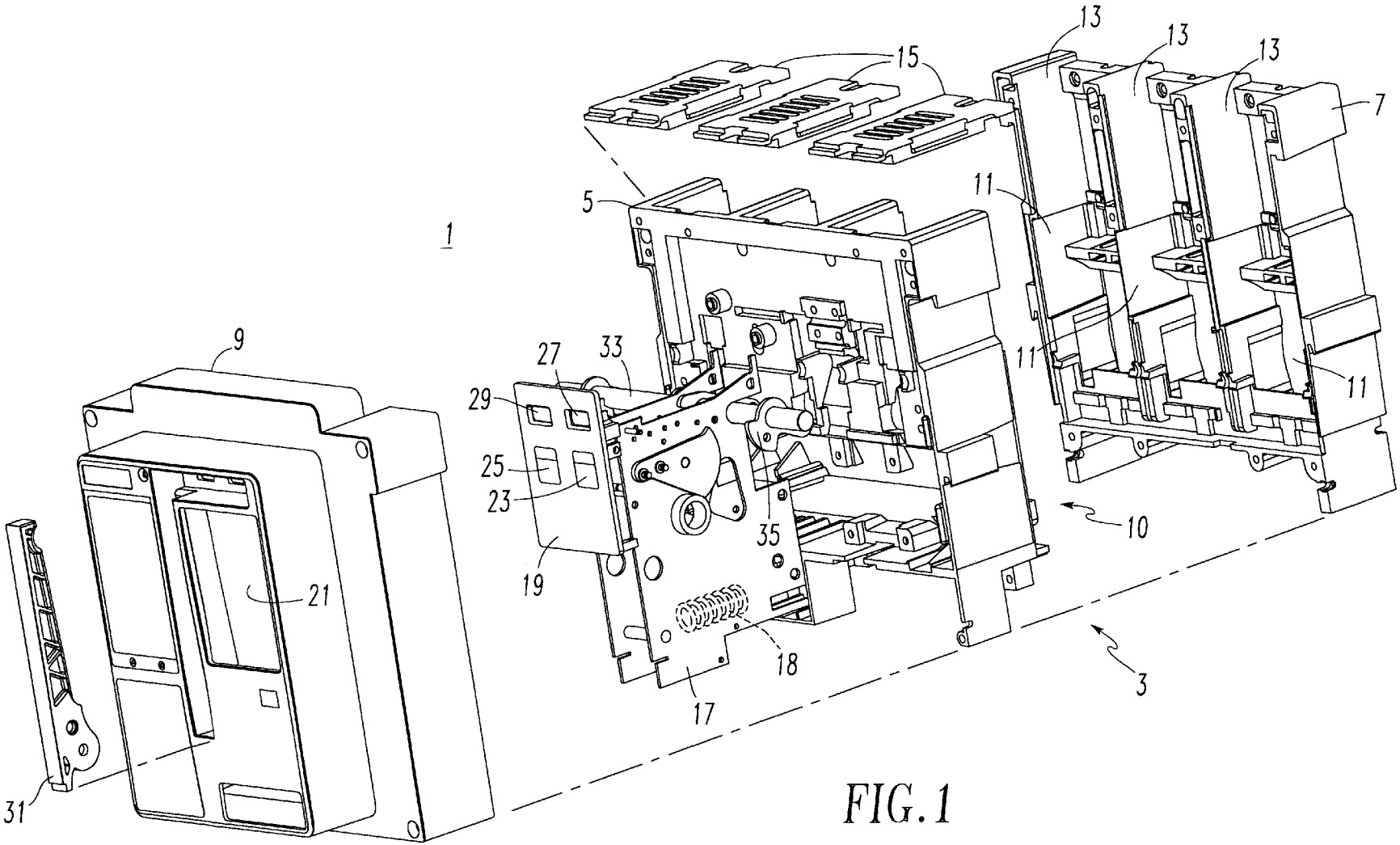
FIG. 1 is an exploded isometric view of a power air circuit breaker incorporating the invention.

Referring to FIG. 1, the power air circuit breaker 1 incorporating the invention has a housing 3 which includes a molded front casing 5 and rear casing 7, and a cover 9. The exemplary circuit breaker 1 has three poles 10 with the front and rear casings 5, 7 forming three pole chambers 11. Each pole 10 also has an arc chamber 13 which is enclosed by a ventilated arc chamber cover 15.

The circuit breaker 1 has an operating mechanism 17 which is mounted on the front of the front housing 5 and is enclosed by the cover 9. The operating mechanism 17 has a font face 19 which is accessible through an opening 21 in the cover. The operating mechanism 17 includes a large spring 18 which is charged to store energy for closing the circuit breaker. The face plate 19 mounts a push to close button 23 which is actuated to discharge the close spring for closing the circuit breaker and a push to open button 25 for opening the circuit breaker. Indicators 27 and 29 display the condition of the charge spring and the open/close state of the contacts, respectively. The charge spring is charged by operation of the charging handle 31 or remotely by a motor operator (not shown).

The common operating mechanism 17 is connected to the individual poles by a pole shaft 33 having a lobe 35 for each pole. As is conventional, the operating mechanism 17 includes a trip unit (not shown) which actuates the operating mechanism to open all the poles of the circuit breaker through rotation of the pole shaft 33 in response to predetermined characteristics of the current flowing through the circuit breaker.

As illustrated in FIGS. 2*a*–2*d*, each pole of the circuit breaker 1 includes separable main contacts 37 comprising stationary main contacts 39 and movable main contacts 41. The stationary main contacts 39 are secured to a line conductor 43 which is mounted in and projects rearwardly from the rear casing 7. The movable main contacts 41 are mounted on a moving conductor assembly 45. This assembly includes a contact carrier 47 on which a plurality of contact fingers 49 are pivotally mounted by a pivot pin 51. The movable main contacts 41 are fixed to the contact fingers 49 about midway between the pivot pin 51 and a first or free end 53. Adjacent to the free end 53 of the contact fingers is an arc toe 55 forming a movable arcing contact which cooperates with a toe block 57 forming a stationary arcing contact secured to the line conductor through an electrically conductive spacer 59 to form a set of arcing contacts.

The moving conductor assembly 45 further includes flexible shunts 61 connecting the contact fingers 49 to a load conductor 63 also projecting rearwardly from the rear casing 7. As is conventional, an arc chute 65 is provided in the arc chamber 13. An arc runner 67 guides the arc from the toe block to the arc chamber where it is extinguished in a known manner.

Figure 2A:
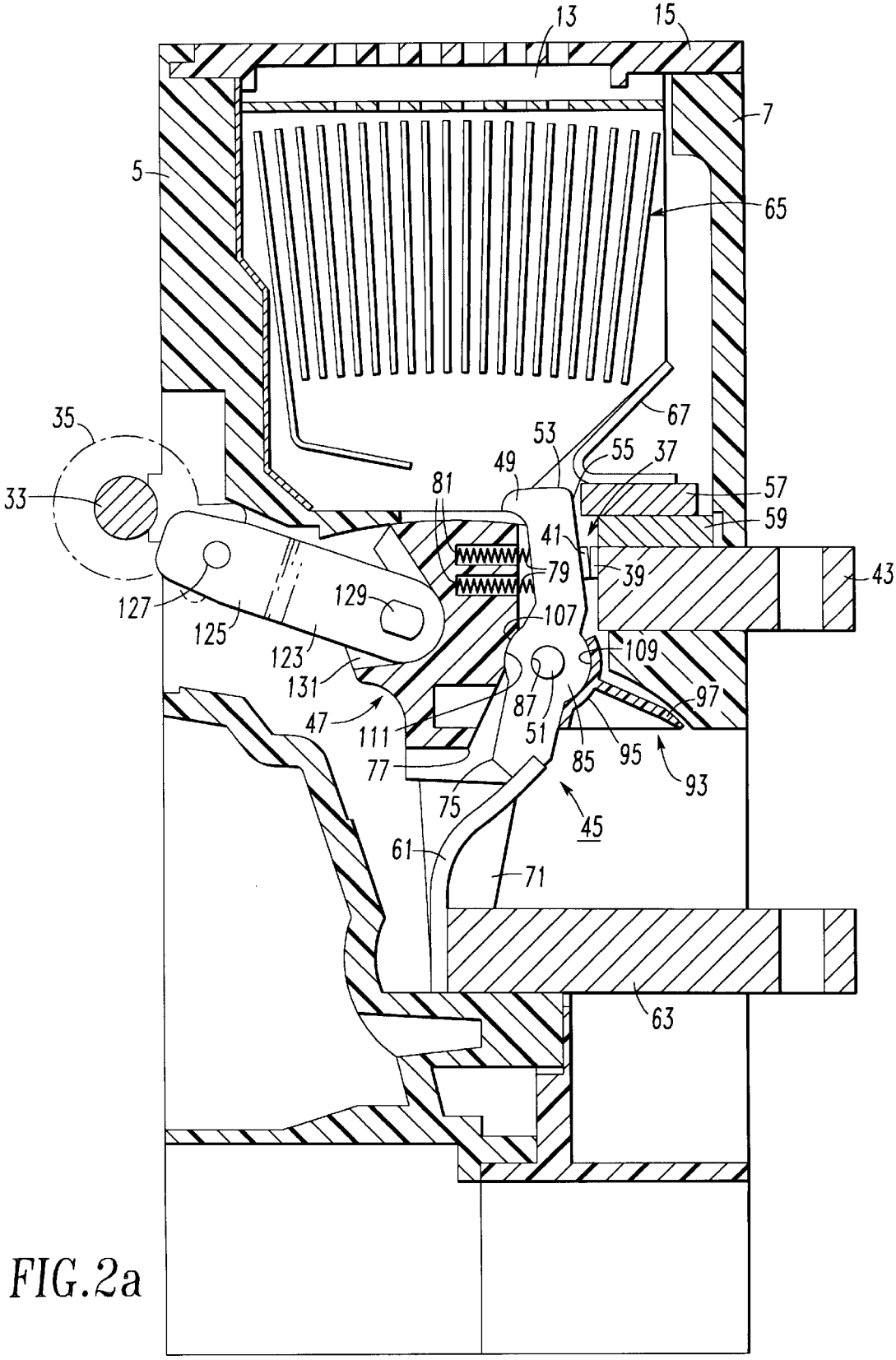
FIG. 2*a* a is a vertical section through the circuit breaker of FIG. 1 shown in the fully closed position.
Figure 2B:
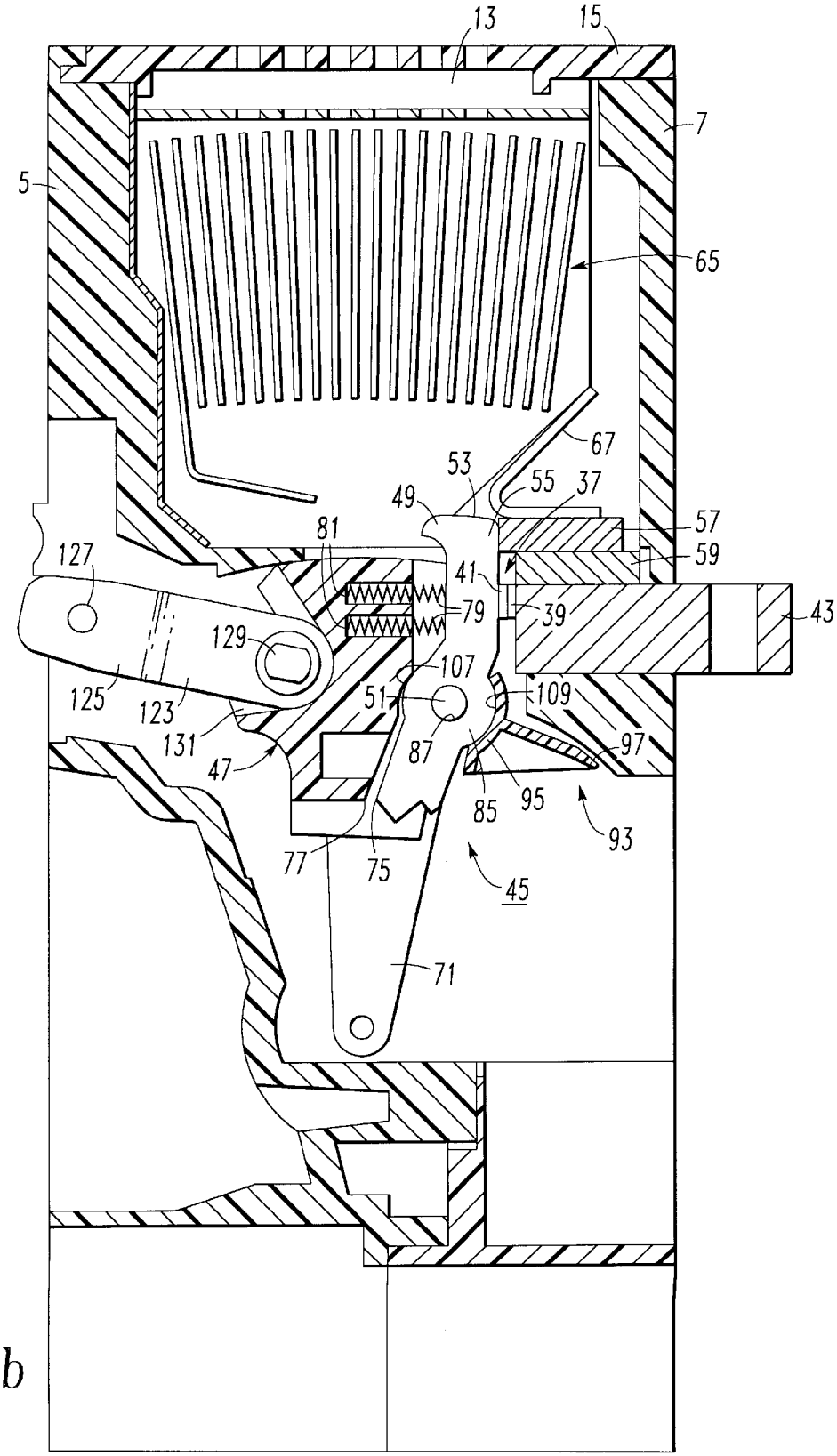
FIG. 2*b* is similar to FIG. 2*a* but illustrating simultaneous contact and toe touch during the closing sequence of the circuit breaker.
Figure 2C:
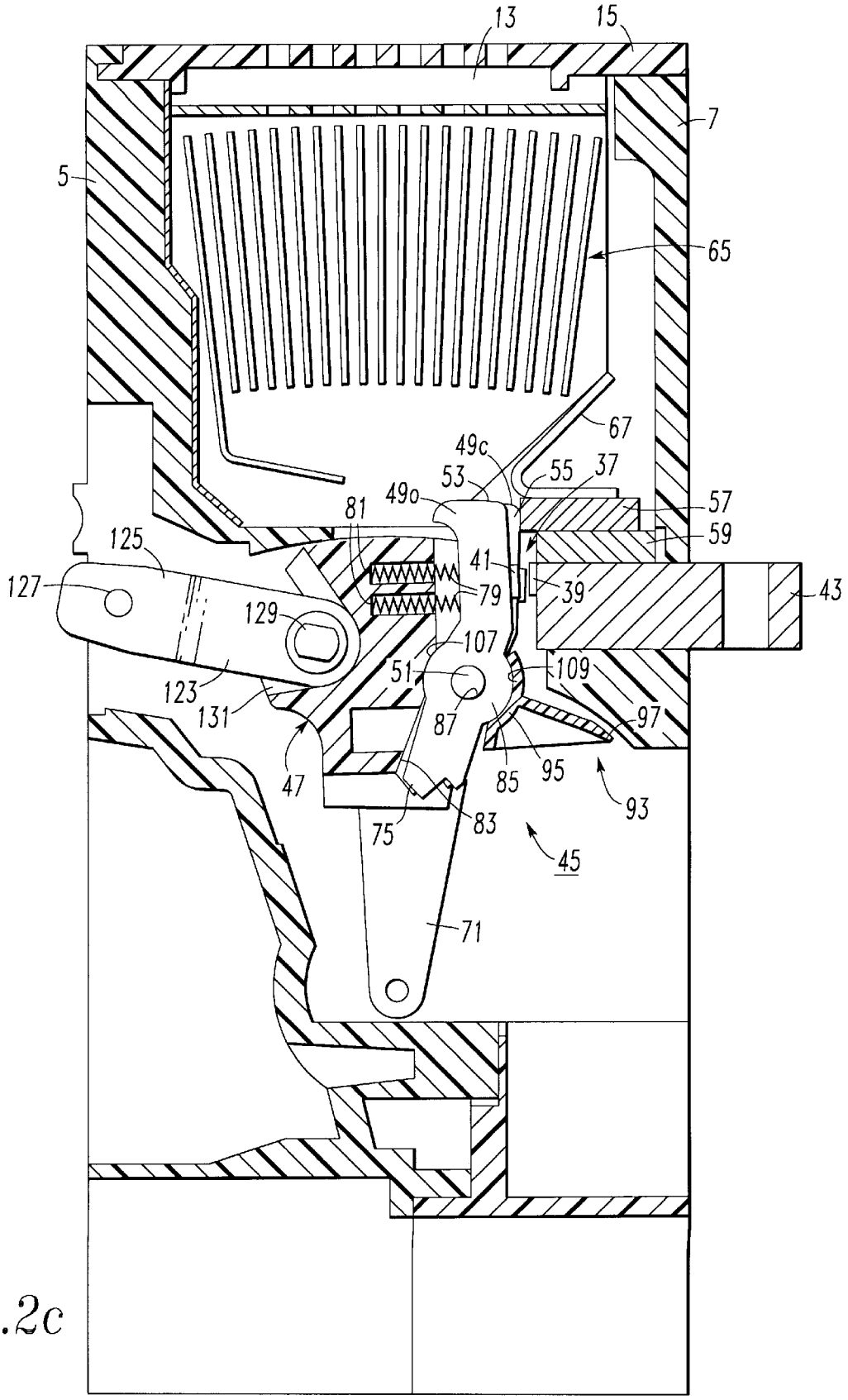
FIG. 2*c* is similar to FIG. 2*a* but showing the contact fingers about to break contact at the arcing toe.
Figure 2D:
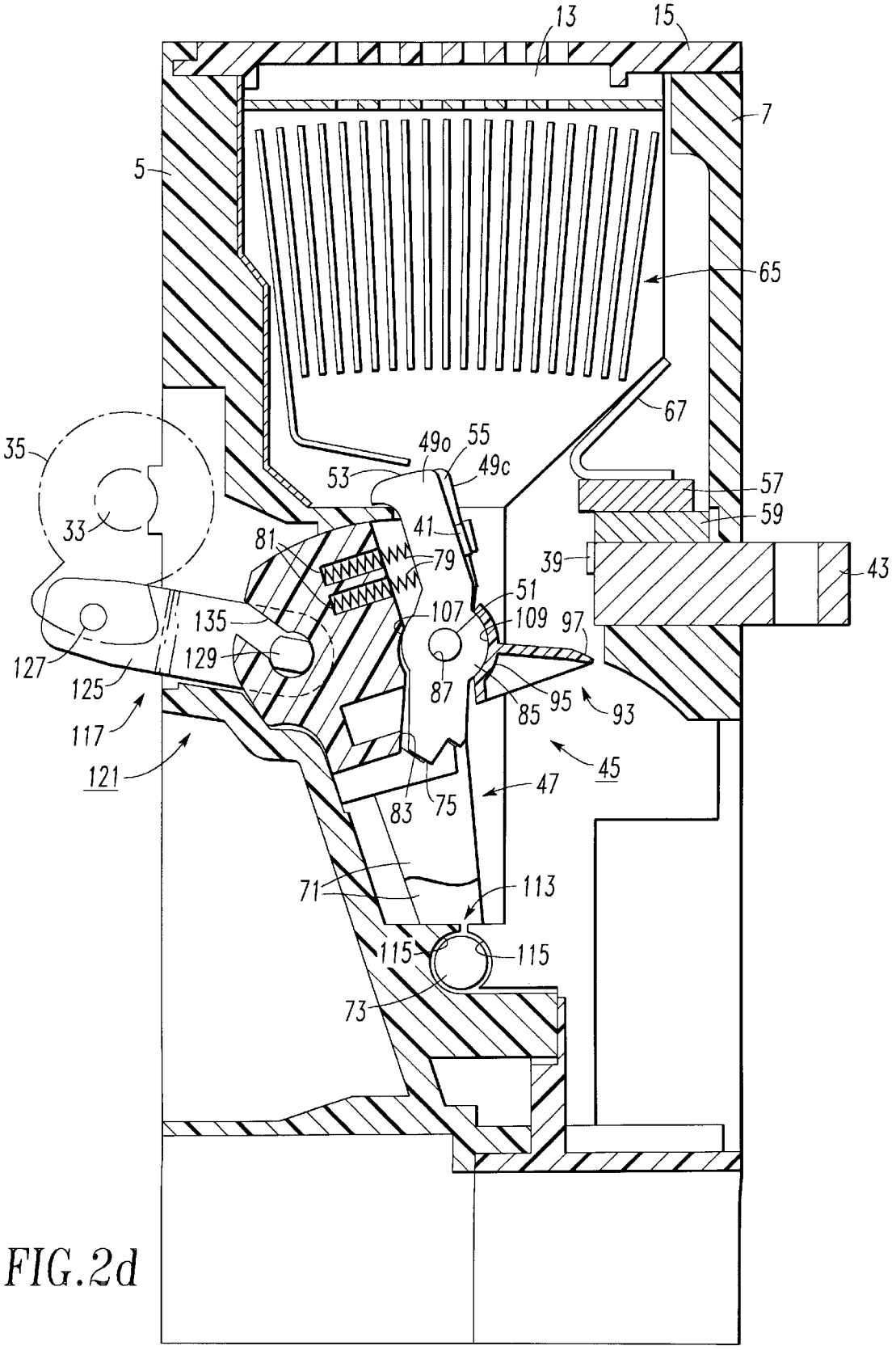
FIG. 2*d* is similar to FIG. 2*a* but showing the contact carrier in the fully open position.
Figure 3:
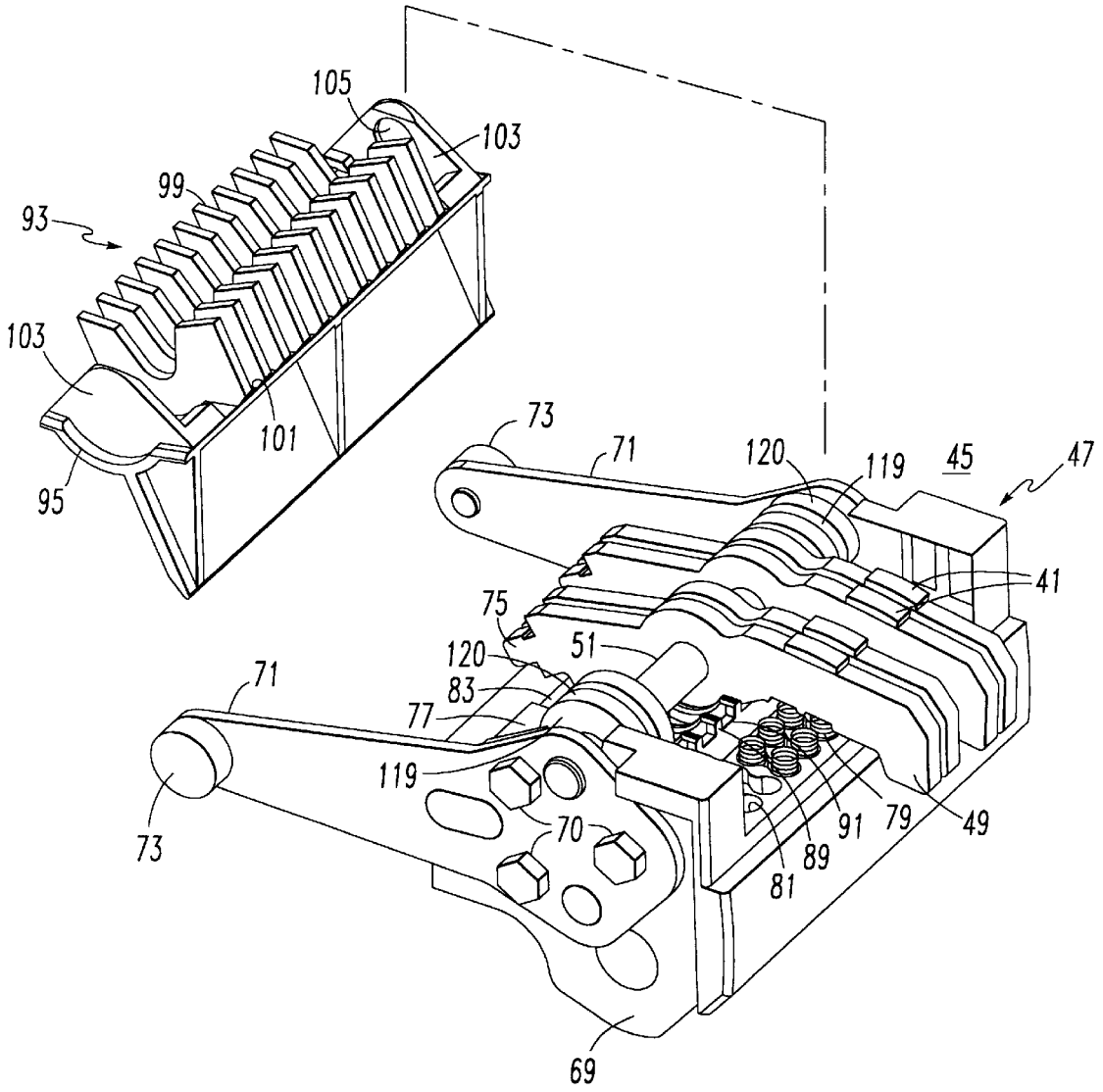
FIG. 3 is an isometric view of the contact carrier which forms part of the circuit breaker with some parts eliminated for clarity and with the seal member removed and rotated.
Figure 4:
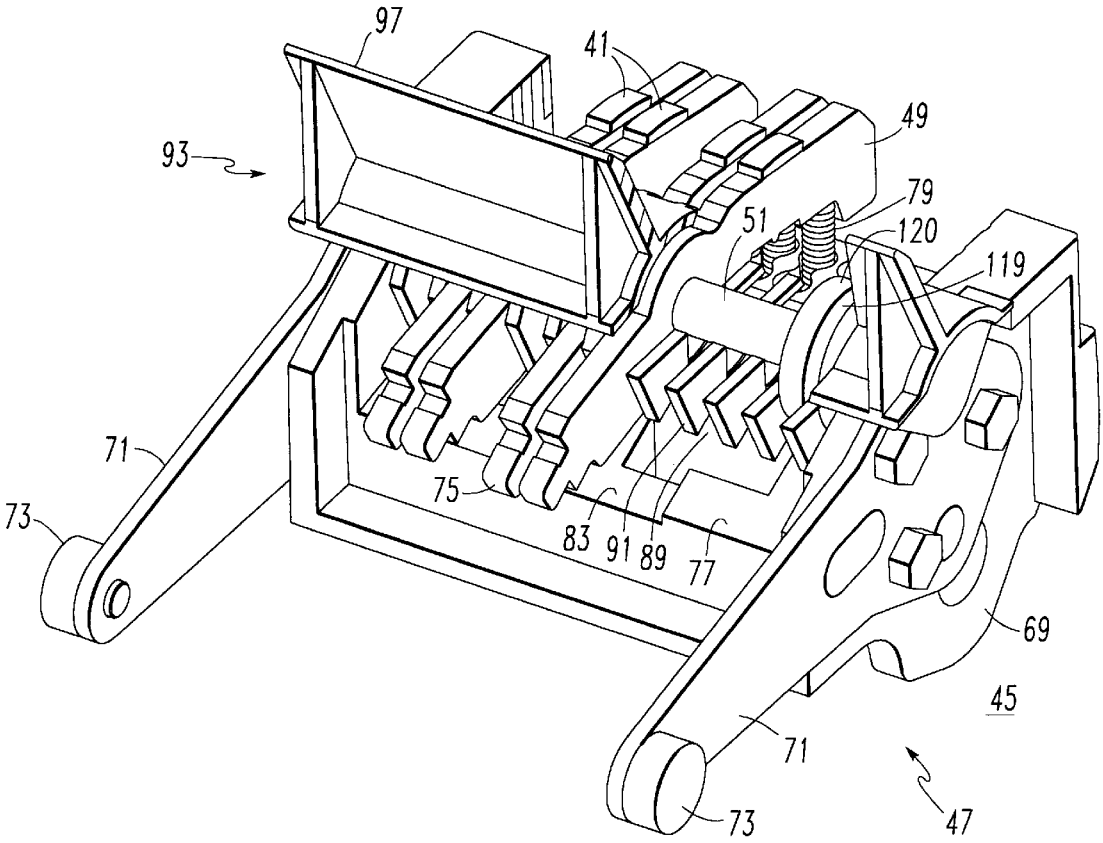
FIG. 4 is an isometric view of the contact carrier from another angle showing some parts eliminated as in FIG. 3, and with the seal member in place but partially cut away.
Figure 5:
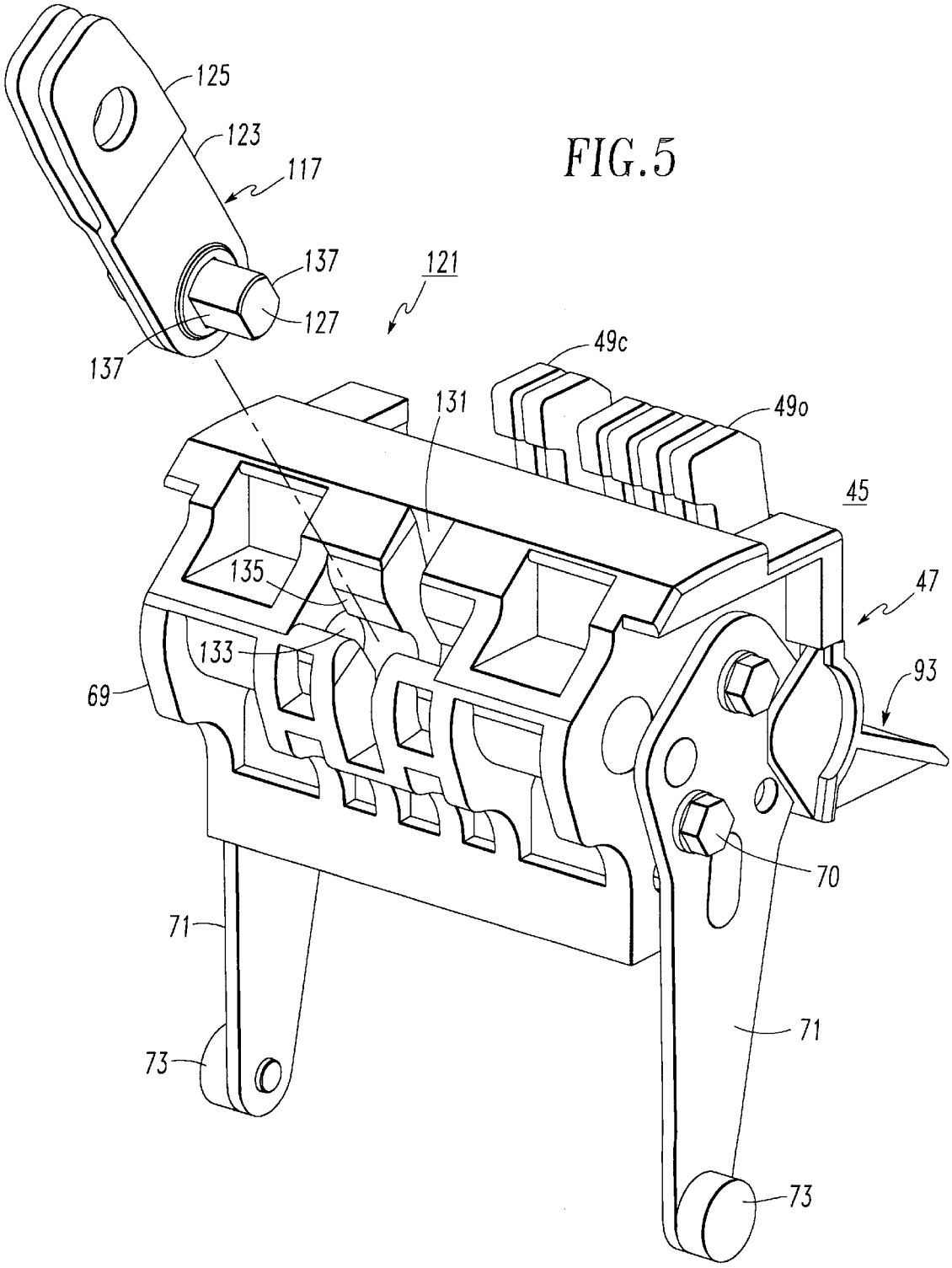
FIG. 5 is an isometric view of the underside of the contact carrier with the drive link assembly separated from the carrier.

Turning to FIGS. 3, 4 and 5 in addition to FIGS. 2*a*–2*d*, the contact carrier 47 includes a molded body 69 and a pair of legs 71 secured to the ends of the body 69 by bolts 70. Mounting pivots 73 project outwardly from the free ends of the legs 71. The pivot pin 51 is supported at its ends in the legs 71. The contact fingers 49 are pivotally mounted on the pivot pin 51. Second ends 75 of the contact fingers 49 are biased against a stop ledge 77 on the molded body 69 by a pair of contact springs 79 seated in recesses 81 in the molded body. The stop ledge 77 has a contour which includes a recessed section 83 in the center of the stop ledge. This allows the contact springs 79 to rotate the center contact fingers which are aligned with the recess 83 to project the first or free ends 53 further from the contact carrier than the other, outside, contact fingers.

The contact fingers 49 have enlarged sections 85 extending radially outward from the mounting aperture 87 which extend into grooves 89 in the carrier body. The grooves 89 are defined by fins 91 which extend between and axially space the contact fingers on the pivot pin 51. The contact carrier 47 also includes a seal member 93 which is best seen in FIG. 3 where it has been removed from the carrier 47 and rotated 180°. This seal member 93 has an arcuate base 95 from which a shield panel 97 extends outward. Fins 99 extend radially inward from the seal base to form grooves 101. End walls 103 on the base 95 have confronting circular recesses 105 which engage the ends of the pivot pin 51 to secure the seal member to the carrier body 69 as seen in FIG. 4. In this assembled position, the fins 99 on the seal member 93 extend between the contact fingers 49 and align with the fins 91 on the carrier body to form a seal which prevents the flow of arc gases from passing through the spaces between the contact fingers. As can be seen from FIG. 2*d* the seal panel 97 additionally restricts flow of arc gases around the carrier 47 as the contacts open.

Referring to FIG. 2*a*, the enlarged sections 85 of the contact fingers 49 have radial convex surfaces 107 which seat on radially concave surfaces 111 and 109 in the grooves 89 in the carrier body 47 and grooves 101 in the seal member 93. These surfaces serve to transmit reaction forces between the contact fingers 49 and the carrier body 69 to prevent bending of the pivot pin 51. This permits the pin 51 to be made of lighter gage or more economical material. Also, the supports for the pivot pin 51, namely the legs 71, have reduced loads to support. This seating of the radial surfaces maintains the gas seal while allowing the contact fingers to rotate.

As shown in FIG. 2*d*, the contact carrier 47 is pivotally mounted for rotation to open and close the separable contacts 37. Bearing pockets 113 are formed by mating recesses 115 in the front casing 5 and rear casing 7 for the pivot 73 on the free ends of the legs 71. The carrier 47 is rotated about the pivots 73 by a link assembly 117 pivotally connected to the pole lobe 35 on the pole shaft 33.

The operation of the circuit breaker 1 is as follows: with the contact carrier 47 rotated to the fully closed position shown in FIG. 2*a*, the separable contacts 37 are closed to complete a circuit which includes the line conductor 43, the fixed contacts 39, the movable contacts 41, the contact arms 49, the flexible shunts 61 and the load conductor 63. In this fully closed position, the arcing contacts are open. Also, in the fully closed position the second ends 75 of the contact arms are spaced from the stop ledge 77. The contact springs 79 maintain contact pressure between the fixed and movable contacts 39, 41.

As the circuit breaker begins to open, the contact carrier 49 begins to rotate counterclockwise to the position shown in FIG. 2*b*. In this position, with the carrier slightly spaced counterclockwise from the position in FIG. 2*a*, the contact springs 79 rock the contact fingers 49 clockwise so that they rock about the separable contacts 37 and close the arcing contacts. At this point, current flows both through the closed separable contacts and arcing contacts. As the contact carrier continues its counterclockwise rotation during opening and reaches the position shown in FIG. 2*c* the separable contacts have separated. In addition, the second ends 75 of the outer contact fingers 49*o* in FIG. 2*c* have seated on the stop ledge 77 and are therefore rotated with the carrier to open the associated arcing contacts as well as the separable contacts. However, the second ends of the center contact fingers 49*c* enter the recess 83 in the stop ledge 77 and therefore can continue to rotate and maintain the center arcing contacts closed. Continued rotation of the carrier 47 in the counterclockwise direction then results in the drawing of an arc between a toe block 57 and the arc toes 55*c* on the center contact fingers only. This arc is then transferred by the arc runner 67 to the arc chute 65 where it is extinguished.

FIG. 2*d* shows the carrier in the fully open position with the center contact fingers 49*c* advanced. Thus, as the carrier 47 moves to the closed position during the next closing cycle, the arcing contacts of the center contact arms will touch first followed by the arcing contacts of the outer contact fingers. This will cause the contact fingers to rock to the position shown in FIG. 2*b* where both the arcing contacts and the separable contacts are closed. As the carrier reaches the fully closed position of FIG. 2*a*, the arcing contacts separate and all the current flows through the closed separable contacts 37.

The circuit breaker I is constructed in modular form so that the same basic construction can be used for a wide range of current ratings. For the highest current rating, the maximum number of contact fingers are installed in the carrier. For the exemplary carrier, this is 12 contact fingers. For such high current ratings an additional set of flexible shunts (not shown) can be connected between the contact fingers and the load conductor 63. In these applications, larger line conductors 43 and load conductors 63 are used. For lower current ratings, fewer contact fingers 49 are required. In these circumstances, annular spacers 119 replace the removed contact fingers. Thus, as shown in FIGS. 3 and 4, the two outer contact fingers at each end of the carrier have been replaced by these annular spacers 119. These annular spacers perform two functions: they have the same radially convex surface 120 which seats against the radial surfaces 109 and 111 as the contact fingers they replace to transmit reaction forces between the contact fingers and the carrier, and they block the flow of arc gases.

Figure 6:
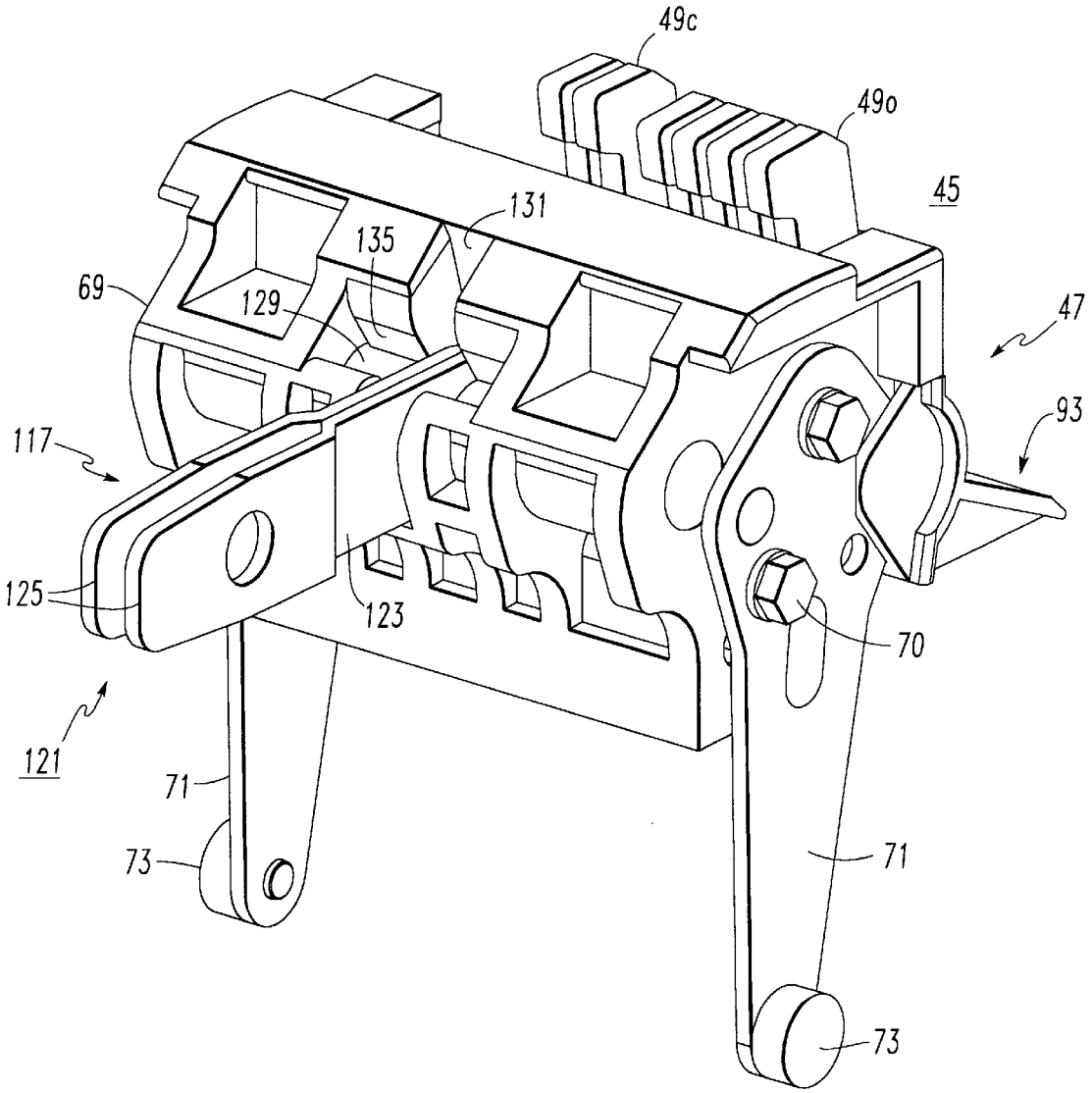
FIG. 6 is a view similar to FIG. 5 showing the drive link assembly engaging the carrier.
Figure 7:
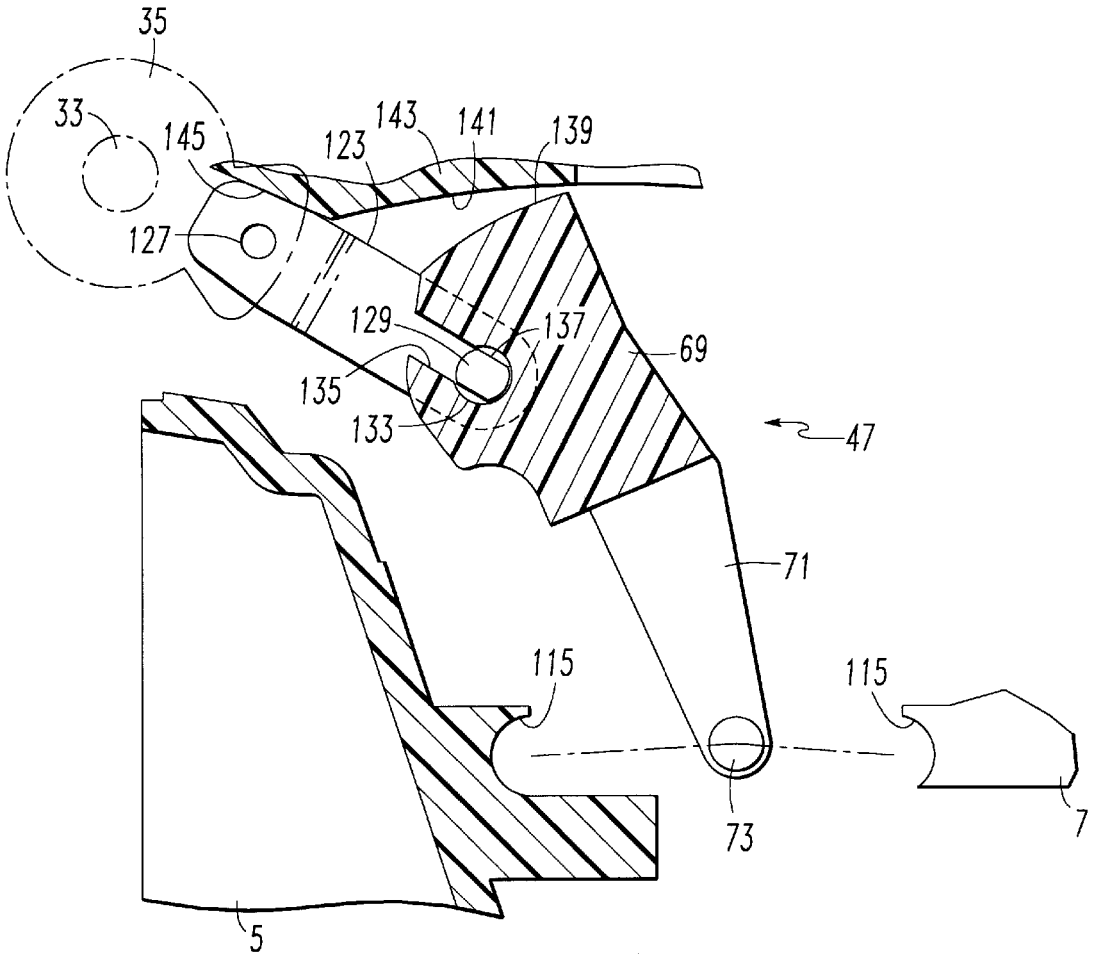
FIG. 7 is a schematic view showing the contact carrier rotated to disconnect the carrier from the drive link for removal from the circuit breaker.

Another unique aspect of the circuit breaker 1 is the connection 121 between the carrier 47 and the pole shaft lobe 35. Referring to FIGS. 2*a*, 5 and 6, this connection 121 comprises the link assembly 117 and its pivotal connection to the pole lobe 35 and to the carrier 47. The link assembly 117 includes a pair of links 123 having off-set ends 125 which straddle the pole lobe 35 to which they are connected by a pin 127. A drive pin 129 extends transversely through the other ends of the links 123 and is fixed thereto so that it cannot rotate with respect to the links. The back of the carrier 47 is provided with a groove 131 sized to pivotally receive the links 123. A circular 131. is molded into the contact carrier 47 transverse to the groove 131. A pair of slots 131 in the groove 131 lead to the passage 133. The drive pin 129 is freely rotatable in the passage 133, but is keyed by flats 137 to slide through the slots 133 only at a predetermined rotational orientation between the drive pin 129 and the contact carrier 47. This predetermined position between the drive pin 129 and the carrier 47 cannot be established with the carrier pivotally mounted in the housing 3 for rotation as shown in FIGS. 2*a*–2*d*. As previously discussed, the pivots 73 on the legs 71 of the contact carrier are captured in bearing pockets 113 formed by the confronting recesses 115 in the front casing 5 and rear casing 7. In order to install or remove the carrier 47, the rear casing 7 is removed. This allows the pivot 73 to be moved to the right by rotation of the arcuate surface 139 on carrier body 69 centered on the pivots 73 against the surface 141 on the front casing 5 as shown in FIG. 7. This aligns the slots 135 with the flats 137 on the drive pin 129 so that as the contact carrier 47 is withdrawn to the right the drive pin 129 passes through the slots 135. Preferably, the links 123 are provided with a camming surface 145 which bears against the partition 143 in the housing to position the links 123 as shown in FIG. 7 for installation of a new or repaired contact carrier 47.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. Electrical switching apparatus comprising:

a housing; and at least one pole comprising:

a first conductor having at least one stationary contact mounted in said housing;

at least one elongated contact finger having a movable contact;

a contact carrier having a pivot pin on which said at least one contact finger is rotatably mounted;

means mounting said contact carrier for movement between a closed position in which said movable contact engages said stationary contact and an open position in which the movable contact is spaced from the fixed contact;

contact springs mounted in said contact carrier and biasing said at least one contact finger about said pivot pin to apply contact pressure to said movable contact with said contact carrier in said closed position;

said at least one contact finger having a pivot aperture through which said at least one contact finger is pivotally mounted on said pivot pin and having a radial convex surface centered on said pivot aperture, and said contact carrier having a radial concave surface on which said radial convex surface on said at least one contact finger seats to transfer into said contact carrier reaction forces exerted on said at least one contact finger with said contact carrier in said closed position and tending to bend said pivot pin;

a plurality of said contact fingers rotatably mounted in spaced parallel relation on said pivot pin and each having said radial convex surface centered on said pivot aperture and which seats on said radial concave surface on said contact carrier; and wherein said contact carrier has seal means between said plurality of contact fingers blocking the flow of arcing gases back through said contact carrier between said contact fingers from arcs formed during separation of said movable contacts and said stationary contacts.

2. The electrical switching apparatus of claim 1 adapted for selectable current ratings wherein a selected number of said contact fingers are mounted on said pivot pin for a selected current rating with said selected number being a first number for a maximum current rating and a second number less than said first number for a lower current rating, and including annular spacers equal in number to a difference between said first number and second number mounted on said pivot pin and which annular spacers seat on said radial concave surface on said contact carrier, said seal means blocking the flow of arcing gases between said spacers as well as said contact fingers.

3. The electrical switching apparatus of claim 2 wherein said contact fingers have a first end and a second end with said pivot aperture intermediate of said first and second ends, and arcing toes adjacent to said first ends of said contact fingers and with said movable contact, which is a movable main contact, positioned between said movable arcing toe and said pivot aperture, and wherein said carrier has a stop against which said contact springs bias said second ends of said contact fingers when said contact carrier is not in said closed position, said stop having a contour which projects inward of said contact fingers farther toward stationary contacts including stationary main contacts and stationary arcing toe blocks than outward of said contact fingers, such that said arcing toes of said inner contact fingers are first to contact said stationary arcing toe blocks on closing and last to separate on opening.

4. Electrical switching apparatus comprising:

a housing; and at least one pole comprising:

a first conductor having at least one stationary contact mounted in said housing;

at least one elongated contact finger having a movable contact;

a contact carrier having a pivot pin on which said at least one contact finger is rotatably mounted;

means mounting said contact carrier for movement between a closed position in which said movable contact engages said stationary contact and an open position in which the movable contact is spaced from the fixed contact;

contact springs mounted in said contact carrier and biasing said at least one contact finger about said pivot pin to apply contact pressure to said movable contact with said contact carrier in said closed position;

said at least one contact finger having a pivot aperture through which said at least one contact finger is pivotally mounted on said pivot pin and having a radial convex surface centered on said pivot aperture, and said contact carrier having a radial concave surface on which said radial convex surface on said at least one contact finger seats to transfer into said contact carrier reaction forces exerted on said at least one contact finger with said contact carrier in said closed position and tending to bend said pivot pin;

a plurality of said contact fingers rotatably mounted in spaced parallel relation on said pivot pin and each having said radial convex surface centered on said pivot aperture and which seats on said radial concave surface on said contact carrier; and adapted for selectable current ratings wherein a selected number of said contact fingers are mounted on said pivot pin for a selected current rating with said selected number being a first number for a maximum current rating and a second number less than said first number for a lower current rating, and including annular spacers equal in number to a difference between said first number and second number mounted on said pivot pin and which annular spacers seat on said radial concave surface on said contact carrier.

5. Electrical switching apparatus adapted for selected current ratings comprising:

a housing; and at least one pole comprising:

a first conductor having stationary contact means mounted in said housing;

a selected number of contact fingers for a selected current rating with said selected number being a first number for a maximum current rating and a second number less than said first number for a lower current rating, each of said selected number of contact fingers having a movable contact;

a contact carrier having seal means forming a first number of grooves equal in number to said first number of contact fingers, and a pivot pin on which said selected number of contact fingers are pivotally mounted in spaced parallel relation in said grooves;

means mounting said contact carrier for movement between a closed position in which said movable contacts engage said stationary contact means, and an open position in which the movable contacts are spaced from the stationary contact means;

contact springs mounted in said contact carrier and biasing said selected number of contact fingers about said pivot pin to apply contact pressure to said movable contacts with said contact carrier in said closed position; and spacers mounted on said pivot pin and received in grooves in said carrier not occupied by said selected number of contact fingers.

6. The electrical switching apparatus of claim 5 wherein said spacers are annular.

7. The electrical switching apparatus of claim 6 wherein said contact fingers have radial convex surfaces centered on apertures through which said pivot pin extends, and wherein said grooves in said contact carrier have radial concave surfaces on which said radial convex surfaces of said contact fingers and said annular spacers seat.

8. The electrical switching apparatus of claim 5 wherein said contact fingers have a first end and a second end with a pivot aperture intermediate said first and second ends through which said pivot pin extends, and a movable arcing toe adjacent to said first end of said contact finger and with said movable contact, which is a movable main contact, positioned between said movable arcing toe and said pivot aperture, and wherein said contact carrier has a stop against which said contact springs bias said second ends of said contact fingers when said contact carrier is not in said closed position, said stop having a contour which projects selected ones of said contact fingers farther toward stationary contacts including stationary main contacts and stationary arcing toe blocks than others of said contact fingers, such that the arcing toes of said selected contact fingers are first to contact said stationary arcing toe blocks on closing and last to separate on opening.

9. The electrical switching apparatus of claim 8 wherein said selected ones of said contact fingers which project farther toward said stationary arcing toe blocks are inner contact fingers and said other contact fingers are outer contact fingers.

10. Electrical switching apparatus comprising:

a housing; and at least one pole comprising:

a first conductor having stationary contacts mounted in said housing;

a plurality of elongated contact fingers each having a first end, a second end, a pivot aperture intermediate of said first and second ends, a movable arcing toe adjacent to said first end, and a movable main contact between said movable arcing toe and said pivot aperture;

a contact carrier having a pivot pin on which said elongated contact fingers are rotatably mounted in spaced parallel relation, a stop, and contact springs biasing said second ends of said elongated contact fingers about said pivot pin towards said stop; and means mounting said contact carrier for movement between a closed position in which said movable main contacts engage said stationary contacts and an open position in which said contact fingers are spaced from said first conductor;

said stop having a contour against which said second ends of said contact fingers are biased by said contact springs with said contact carrier not in said closed position and which projects selected ones of said contact fingers farther toward said stationary contacts than others of said contact fingers, such that said arcing toes of said selected contact fingers are first to contact said stationary contacts on closing and last to separate on opening.

11. The electrical switching apparatus of claim 10 wherein said selected ones of said contact fingers are inner ones, and said others, of said contact fingers are outer contact fingers.

12. Electrical switching apparatus comprising:

a housing; and at least one pole mounted within said housing and comprising:

at least one contact finger;

a contact carrier on which said at least one contact finger is mounted; and means mounting said contact carrier in said housing for movement over a normal range between an open position and a closed position;

an operating mechanism; and connecting means connecting said contact carrier to said operating mechanism for movement thereby between said open and closed positions, said mounting means selectively permitting movement of said contact carrier outside of said normal operating range for engagement and disengagement of said connecting means.

13. The electrical switching apparatus of claim 12 wherein said operating mechanism includes a rotatable pole shaft having at least one pole arm extending transversely therefrom, and said connecting means connects said at least one pole arm to said contact carrier of said at least one pole such that said contact carrier is moved between said open and closed positions through rotation of said pole shaft, said connecting means comprising: a link connected to said at least one pole arm adjacent to a first end, a drive pin extending transversely from a second end of said link, and a groove in said contact carrier sized to pivotally receive said link, a passage within said contact carrier generally transverse to said groove, and at least one slot in said groove and leading to said passage, said slot being narrower than said passage and said drive pin being freely rotatable in said passage and keyed to slide through said slot only with a predetermined rotational orientation between said drive pin and said contact carrier.

14. The electrical switching apparatus of claim 13 wherein said drive pin is cylindrical and keyed to slide in said slot by at least one longitudinal flat.

15. The electrical switching apparatus of claim 14 wherein said means mounting said contact carrier comprises a pivot mount, said pivot mount being releasable to allow rotation of said contact carrier to said predetermined rotational orientation for insertion into and withdrawal from said passage of said drive pin through said slot.

16. The electrical switching apparatus of claim 15 wherein said pivot mount comprises pivots on said contact carrier and bearing pockets in said housing, said housing including a removable section retaining said pivots in said bearing pockets and permitting removal of said pivots from said bearing pockets upon removable of said removable section.

17. The electrical switching apparatus of claim 16 wherein said contact carrier has an arcuate surface centered on said pivots and said housing has a complementary surface adjacent to which said contact carrier rotates between said open and closed positions and on which arcuate surface of said contact carrier is pivoted to rotate said contact carrier to said predetermined rotational orientation.

18. The electrical switching apparatus of claim 13 wherein said connecting means include means for positioning said link to said predetermined rotational orientation for engagement of said drive pin in said slot in said contact carrier.

19. The electrical switching apparatus of claim 18 wherein said link is pivotally connected to said pole arm and wherein said means positioning said link comprises a cam surface on said link which bears against a surface in said housing to position said link to said predetermined rotational orientation.

* * * * *